US007017454B2

(12) United States Patent
Chang

(10) Patent No.: US 7,017,454 B2
(45) Date of Patent: Mar. 28, 2006

(54) ADJUSTABLE WRENCH FOR VEHICLE SERVICE

(76) Inventor: Hsueh Chin Chang, P.O. Box 63-150, Taichung City (406) (TW)

( * ) Notice: Subject to any disclaimer, the term of this patent is extended or adjusted under 35 U.S.C. 154(b) by 65 days.

(21) Appl. No.: 10/876,875

(22) Filed: Jun. 23, 2004

(65) Prior Publication Data

US 2005/0223855 A1 Oct. 13, 2005

(30) Foreign Application Priority Data

Apr. 9, 2004 (TW) ..... 93205417 U

(51) Int. Cl.
*B25B 13/10* (2006.01)

(52) U.S. Cl. ..... 81/176.3; 81/111

(58) Field of Classification Search ..... 81/176.3, 81/176.1, 176.2, 111
See application file for complete search history.

(56) References Cited

U.S. PATENT DOCUMENTS

2005/0034571 A1* 2/2005 Hwang ..... 81/176.3
2005/0217437 A1* 10/2005 Whitehead et al. ..... 81/176.3
2005/0223855 A1* 10/2005 Chang ..... 81/176.3

* cited by examiner

*Primary Examiner*—Lee D. Wilson

(57) ABSTRACT

An adjustable wrench for vehicle service includes a main shaft, a actuated shaft pivotally connected to the main shaft and a controlling unit pivotally mounted on the main shaft for selectively braking the actuated shaft. The main shaft includes a first end having a grip sleeved thereon and a second end having a first hook formed thereon and a first stub extending therefrom. The actuated shaft includes a first end pivotally mounted on the main shaft, and a second end having a second hook formed thereon and a second stub extending therefrom. The first and second hooks are provided to engaged to two stubs extending from a workpiece for detaching/mounting the workpiece. The first and second stubs are inserted into two holes in the workpiece for detaching/mounting the workpiece. The controlling unit controls an angle between the main shaft and the actuated shaft.

1 Claim, 7 Drawing Sheets

ADJUSTABLE WRENCH FOR VEHICLE SERVICE

BACKGROUND OF THE INVENTION

1. Field of the Invention

The present invention relates to an adjustable wrench, and more particularly to an adjustable wrench for vehicle service.

2. Description of Related Art

As well known, a vehicle includes multiple rotating elements mounted thereon by bolts, such as a cooling fan, a belt wheel, a flywheel, a cam and a gear. The rotating element may be rotated when detaching the bolts thereon so that the rotating element needs to be positioned when being dismounted. Consequently, some Y-shaped wrenches are marketed. The Y-shaped wrench has two distal ends facing each other and each having a stub extending therefrom to be inserted into two holes in the rotating element for positioning the rotating element during operating. However, the distance between the two distal ends is invariable so that the conventional Y-shaped wrench cannot be used to various rotating element with various standards.

The present invention has arisen to mitigate and/or obviate the disadvantages of the conventional Y-shaped wrench for vehicle service.

SUMMARY OF THE INVENTION

The main objective of the present invention is to provide an improved adjustable wrench for vehicle service, which can be suitable to various standards.

To achieve the objective, the wrench in accordance with the present invention comprises a main shaft including a grip sleeved on a first end thereof and a first hook formed on a second end of the shaft. A first hole is defined in the main shaft near the first hook and a first stub is axially detachably disposed in the first hole. A first through hole is defined in a middle portion of the main shaft and a guider is longitudinally partially secured in the main shaft between the first through hole and the first hole. The guider has a through hole laterally diametrically defined therein.

An actuated shaft includes a first end and a second end opposite to the first end of the actuated shaft. The first end of the actuated shaft includes a circled periphery having a series of ratchets formed on the circled periphery of the first end of the actuated shaft. A second through hole is centrally defined in the first end of the actuated shaft and aligning with the first through hole in the main shaft. A pivot extends through the second through hole and the first through hole for pivotally mounting the actuated shaft to the main shaft. A second hook is formed on a second end of the actuated shaft and corresponds to the first hook of the main shaft. A second hole is defined in the actuated shaft near the second hook and a second stub is axially detachably disposed in the second hole. The second stub corresponds to the first stub. A pillar is longitudinally pivotally mounted on a middle portion of the actuated shaft and having a post laterally extending therefrom. The post extends through the through hole in the guider and a spring is compressively sleeved on the post between the pillar and the guider. The restitution force of the spring opens the wrench when the actuated shaft is in a free condition.

A controlling unit is pivotally mounted on the main shaft near the grip and corresponds to the first end of the actuated shaft. The controlling unit includes a lever pivotally mounted on the main shaft and having a bore defined in the lever. A pin extends through the bore and the main shaft to pivotally mount the lever to the main shaft. A pawl is formed on a distal end of the lever and engaged to the series of ratchets to limit an angle formed by the main shaft and the actuated shaft. An actuated portion is formed on the lever opposite to the pawl for user to easily operate the lever. A stopper is secured on the main shaft and has a recess defined in the stopper facing the actuated portion of the lever. A tension spring has two opposite ends respectively secured in the recess in the stopper and the actuated portion of the lever for providing a restitution force to the lever and ensuring the pawl of the lever to engage closely to the series of ratchets of the actuated shaft.

Further benefits and advantages of the present invention will become apparent after a careful reading of the detailed description with appropriate reference to the accompanying drawings.

DETAILED DESCRIPTION OF THE INVENTION

Figure 1:
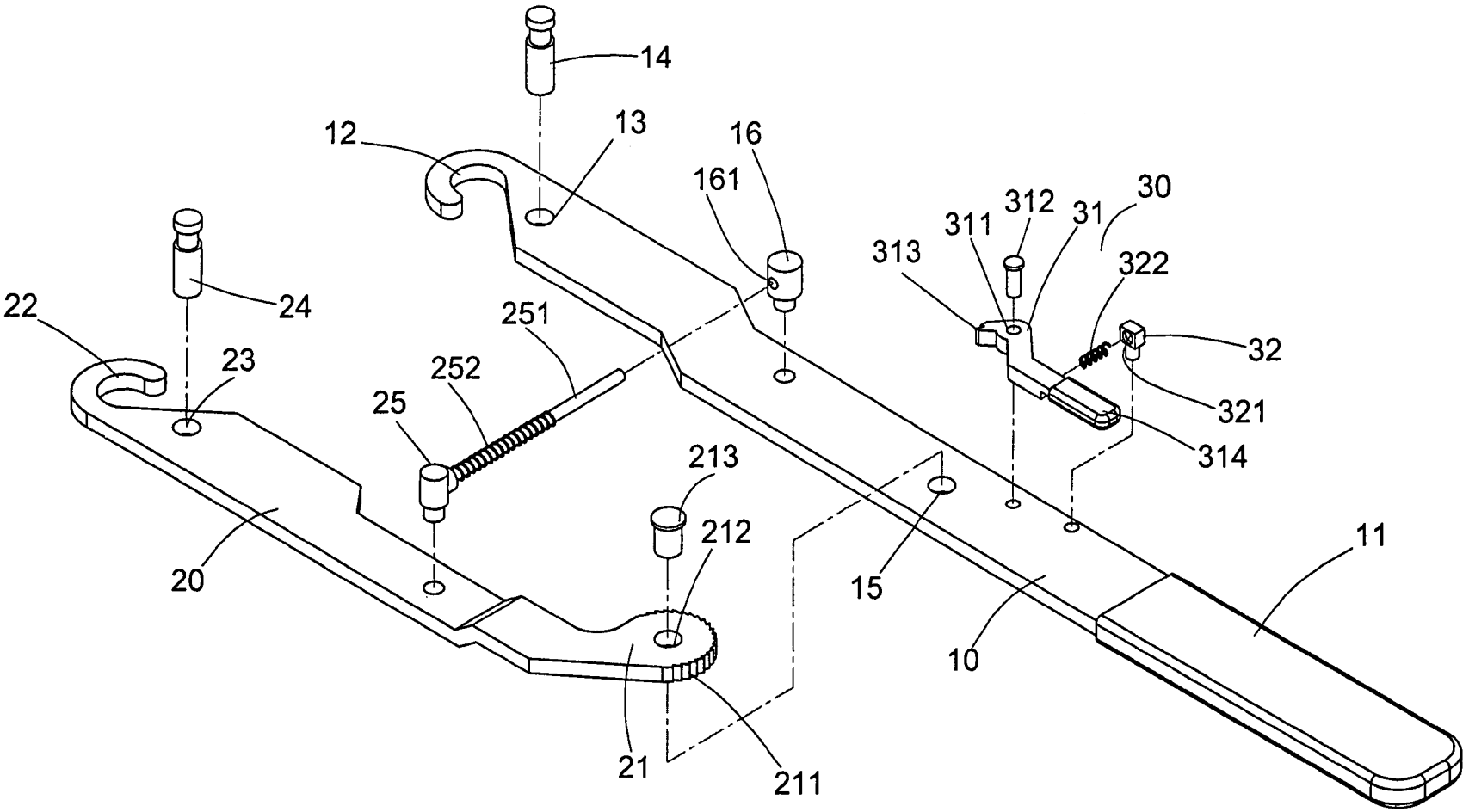
FIG. 1 is an exploded perspective view of an adjustable wrench for vehicle service in accordance with the present invention.
Figure 2:
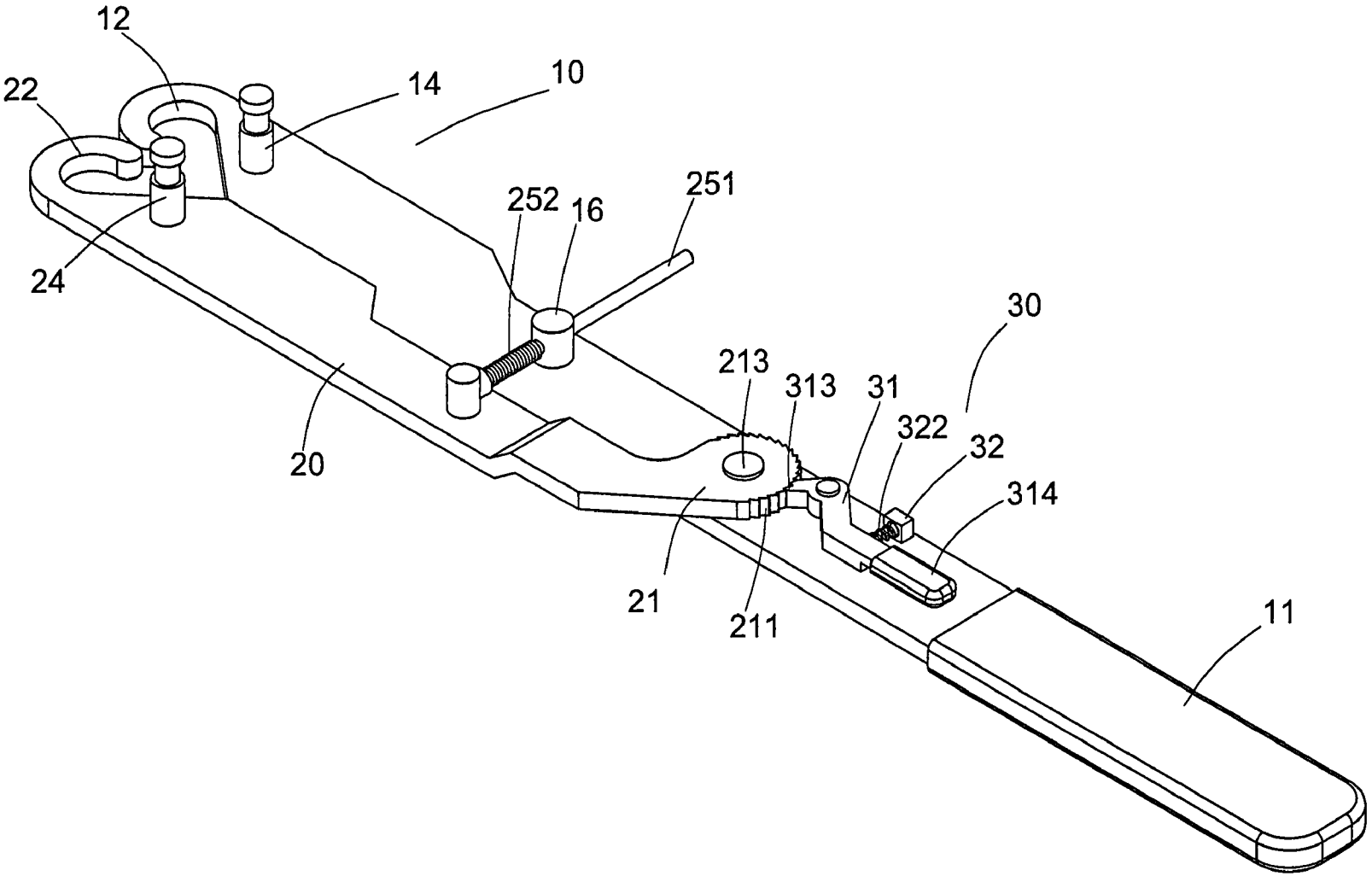
FIG. 2 is a perspective view of an adjustable wrench for vehicle service in accordance with the present invention.
Figure 3:
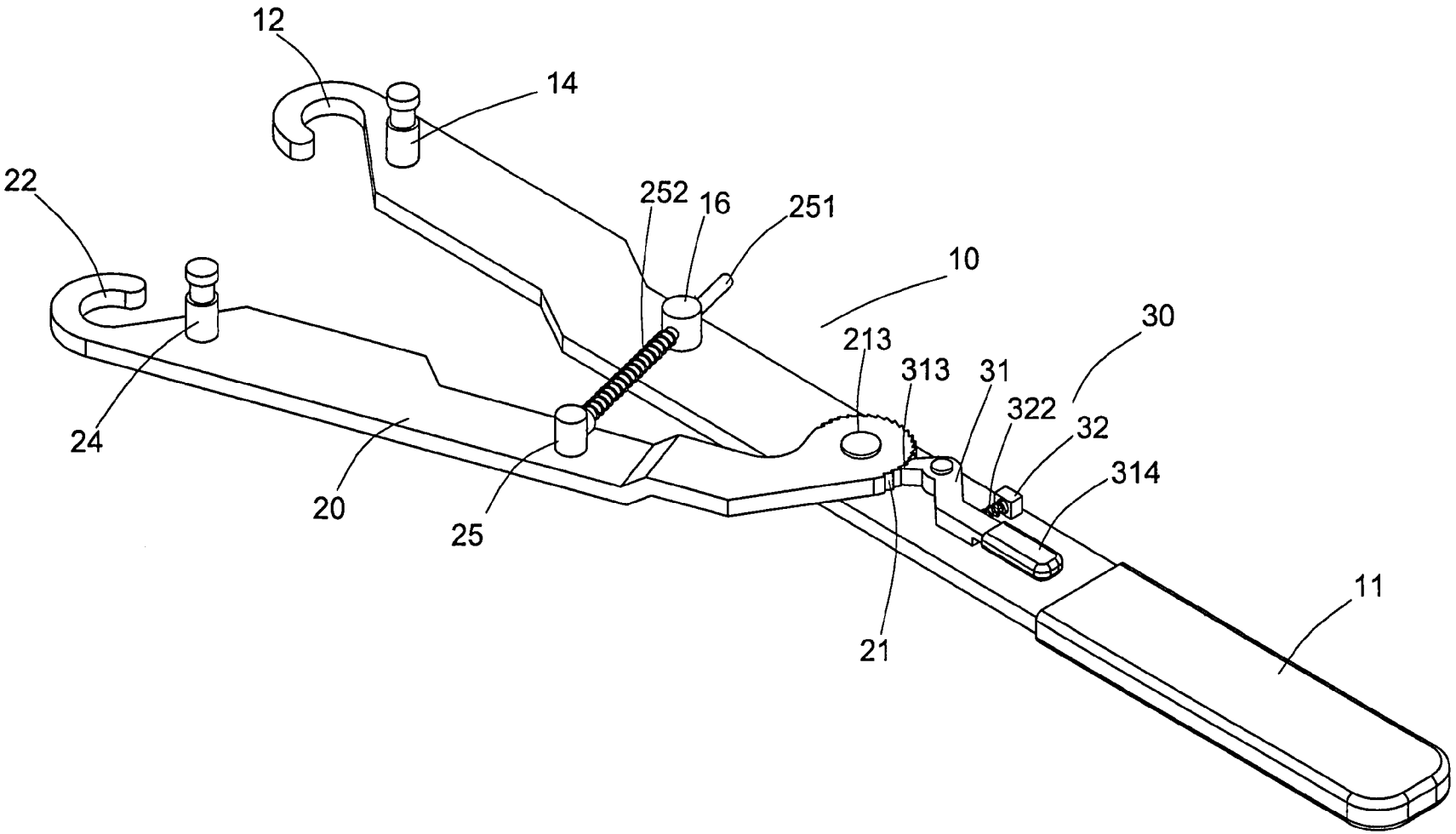
FIG. 3 is a perspective view of the adjustable wrench in FIG. 2 when being opened.

Referring to the drawings and initially to FIGS. 1–3, an adjustable wrench for vehicle service in accordance with the present invention comprises a main shaft (10), an actuated shaft (20) pivotally connected to the main shaft (10) and a controlling unit (30) pivotally mounted on the main shaft (10) for selectively braking the actuated shaft (20).

The main shaft (10) includes a grip (11) sleeved on a first end thereof and a first hook (12) formed on a second end of the main shaft (10). A first hole (13) is defined in the main shaft (10) near the first hook (12) and a first stub (14) is axially detachably disposed in the first hole (13). A first through hole (15) is defined in a middle portion of the main shaft (10) and a guider (16) is longitudinally partially secured in the main shaft (10) between the first through hole (15) and the first hole (13). The guider (16) has a through hole (161) laterally diametrically defined therein.

The actuated shaft (20) includes a first end (21) and a second end opposite to the first end (21) of the actuated shaft (20). The first end (21) of the actuated shaft (20) includes a circled periphery having a series of ratchets (211) formed on the circled periphery of the first end (21) of the actuated shaft (20). A second through hole (212) is centrally defined in the first end of the actuated shaft (20) and aligning with the first through hole (15) in the main shaft (10). A pivot (213) extends through the second through hole (212) and the first through hole (15) for pivotally mounting the actuated shaft (20) to the main shaft (10). A second hook (22) is formed on a second end of the actuated shaft (20) and corresponds to the first hook (12) of the main shaft (10). A second hole (23) is defined in the actuated shaft (20) near the second hook (22) and a second stub (24) is axially detachably disposed in the second hole (23). The second stub (24) corresponds to the first stub (14). A pillar (25) is longitudinally pivotally mounted on a middle portion of the actuated shaft (20) and having a post (251) laterally extending therefrom. The post (251) extends through the through hole (161) in the guider (16) and a spring (252) is compressively sleeved on the post (251) between the pillar (25) and the guider (16). The restitution force of the spring (252) opens the wrench when the actuated shaft (20) is in a free condition.

The controlling unit (30) is pivotally mounted on the main shaft (10) near the grip (11) and corresponds to the first end of the actuated shaft (20). The controlling unit (30) includes a lever (31) pivotally mounted on the main shaft (10) and having a bore (311) defined in the lever (11). A pin (312) extends through the bore (311) and the main shaft (10) to pivotally mount the lever to the main shaft (10). A pawl (313) is formed on a distal end of the lever (31) and engaged to the series of ratchets (211) to limit an angle formed by the main shaft (10) and the actuated shaft (20). An actuated portion (314) is formed on the lever (31) opposite to the pawl (313) for user to easily operate the lever (31). A stopper (32) is secured on the main shaft (10) and has a recess (321) defined in the stopper (32) facing the actuated portion (314) of the lever (31). A tension spring (322) has two opposite ends respectively secured in the recess (321) in the stopper (32) and the actuated portion (314) of the lever (31) for providing a restitution force to the lever (31) and ensuring the pawl (313) of the lever to engage closely to the series of ratchets (211) of the actuated shaft.

Figure 4:
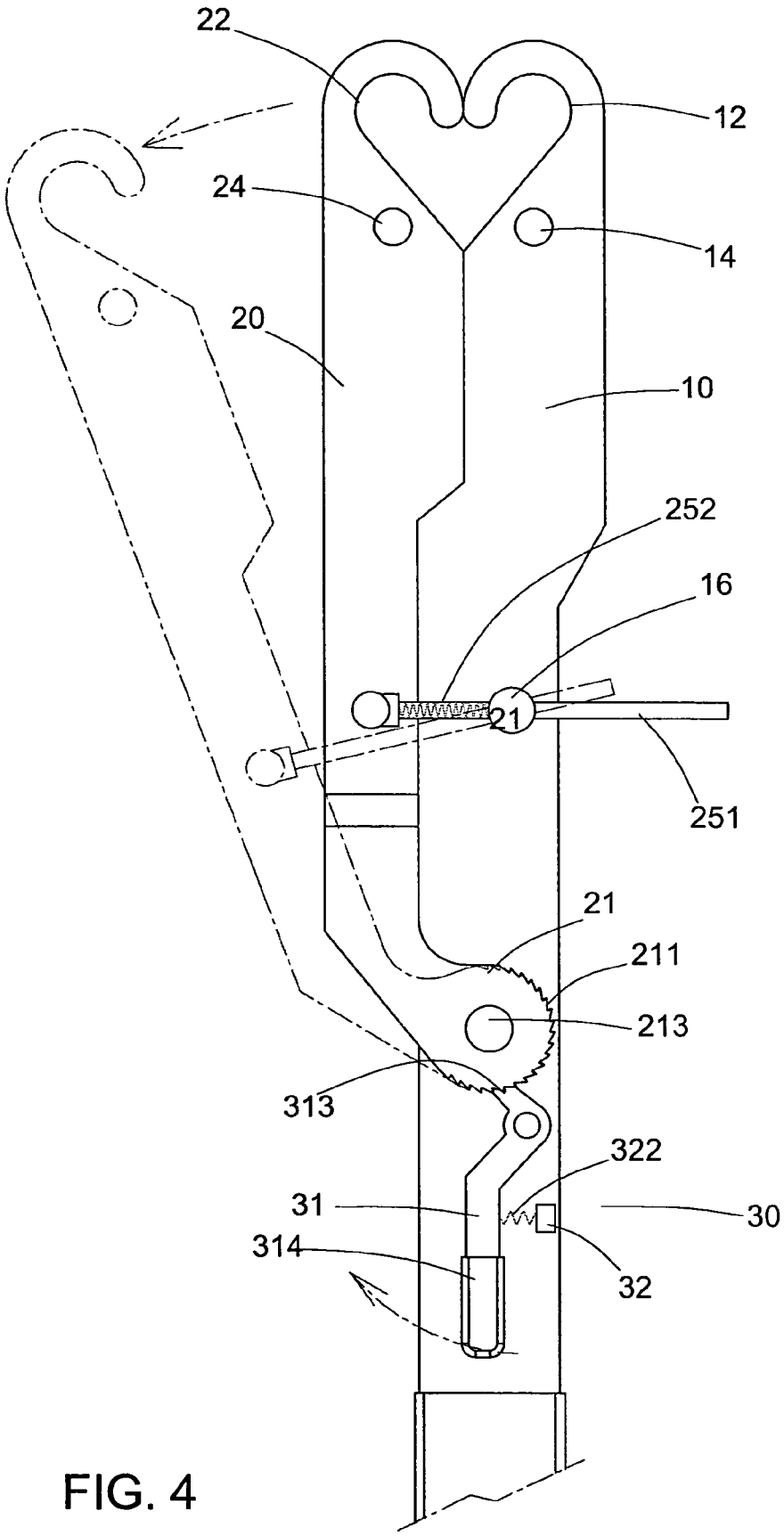
FIG. 4 is a top plan view of the adjustable wrench in FIG. 2 when the adjustable wrench is adjusted.
Figure 5:
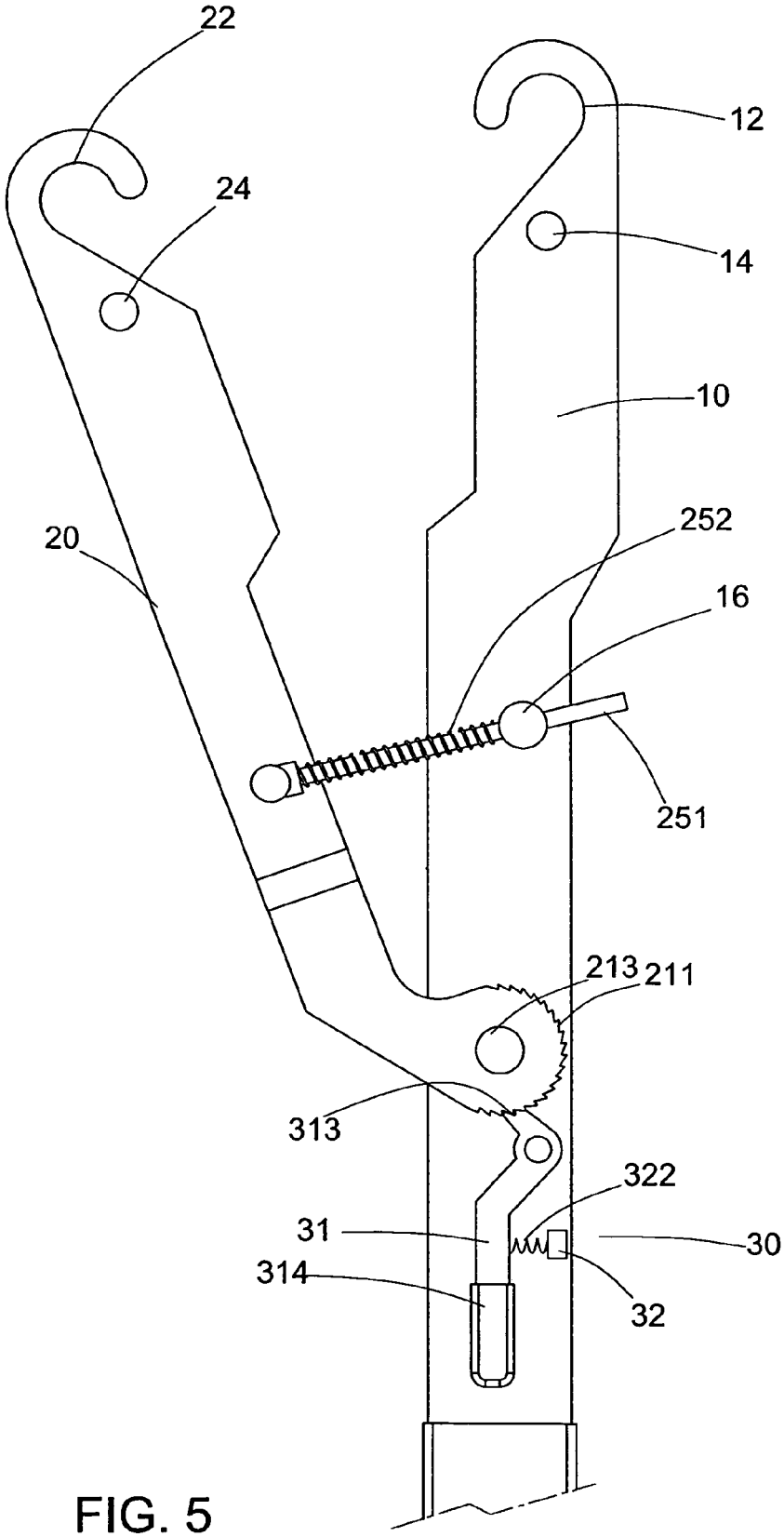
FIG. 5 is a top plan view of the adjustable wrench in FIG. 2 after being adjusted.
Figure 6:
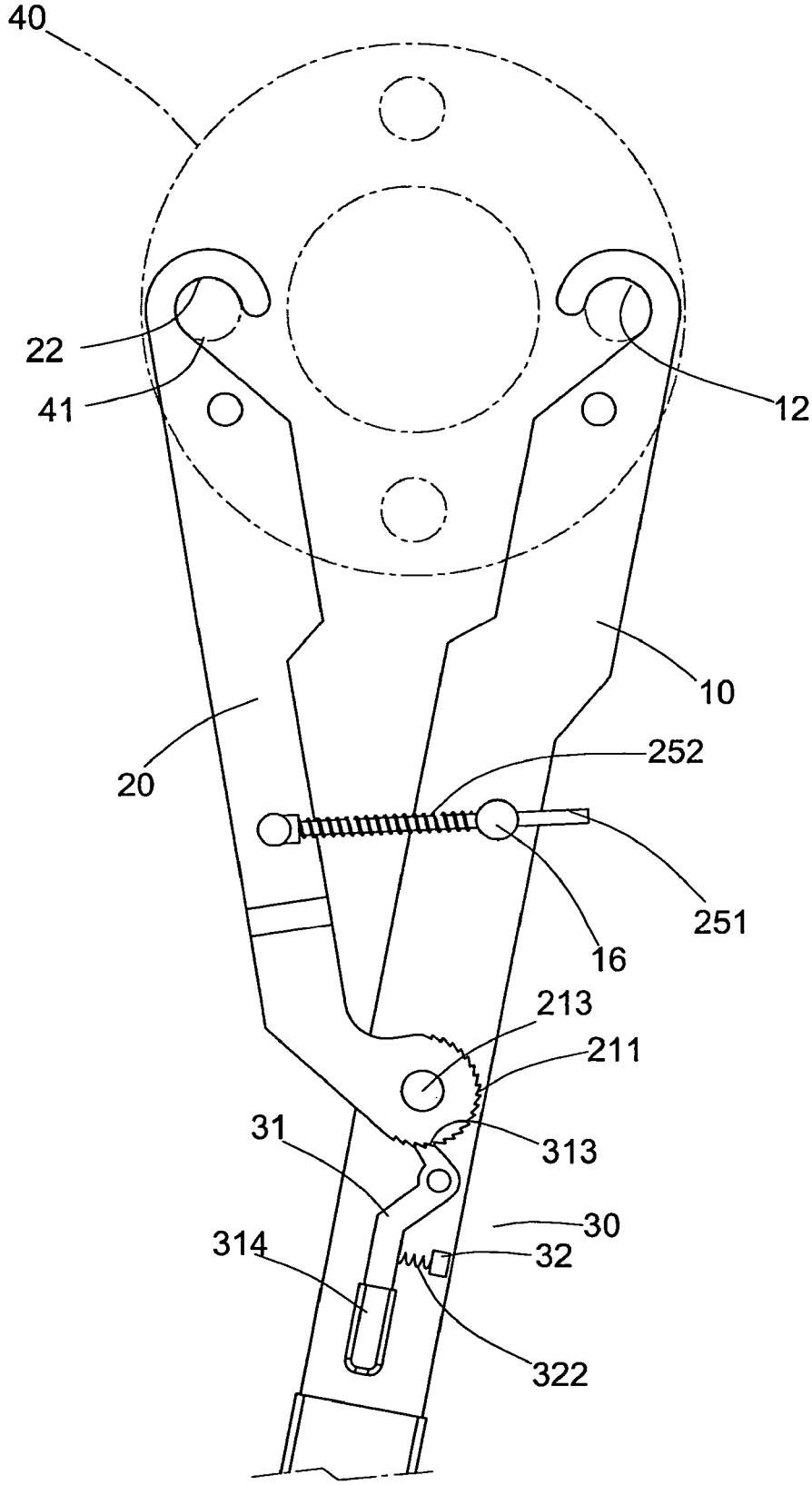
FIG. 6 is a first operational top plan view of the adjustable wrench of the present invention.

With reference to FIGS. 4–6, the actuated shaft (20) is automatically pivotally moved to form an angle between the main shaft (10) and the actuated shaft (20), and corresponds to the stub (41) of a workpiece (40), and the pivot (213) is used as a fulcrum due to the restitution force of the spring (252) when the lever (31) is wrenched to make the pawl (313) be disengaged from the series of ratchets (211). The first hook (12) and the second hook (22) are buckled upon the two stubs (41) respectively of the workpiece (40). Consequently, the user can use the present invention for rotate the workpiece for detaching/mounting the workpiece (40). The angle between the main shaft (10) and the actuated shaft (20) can be freely adjusted according to the standard of the workpiece, and the pawl (313) and the series of ratchets (211) can provide an effect of positioning to the actuated shaft (20) during operating.

Figure 7:
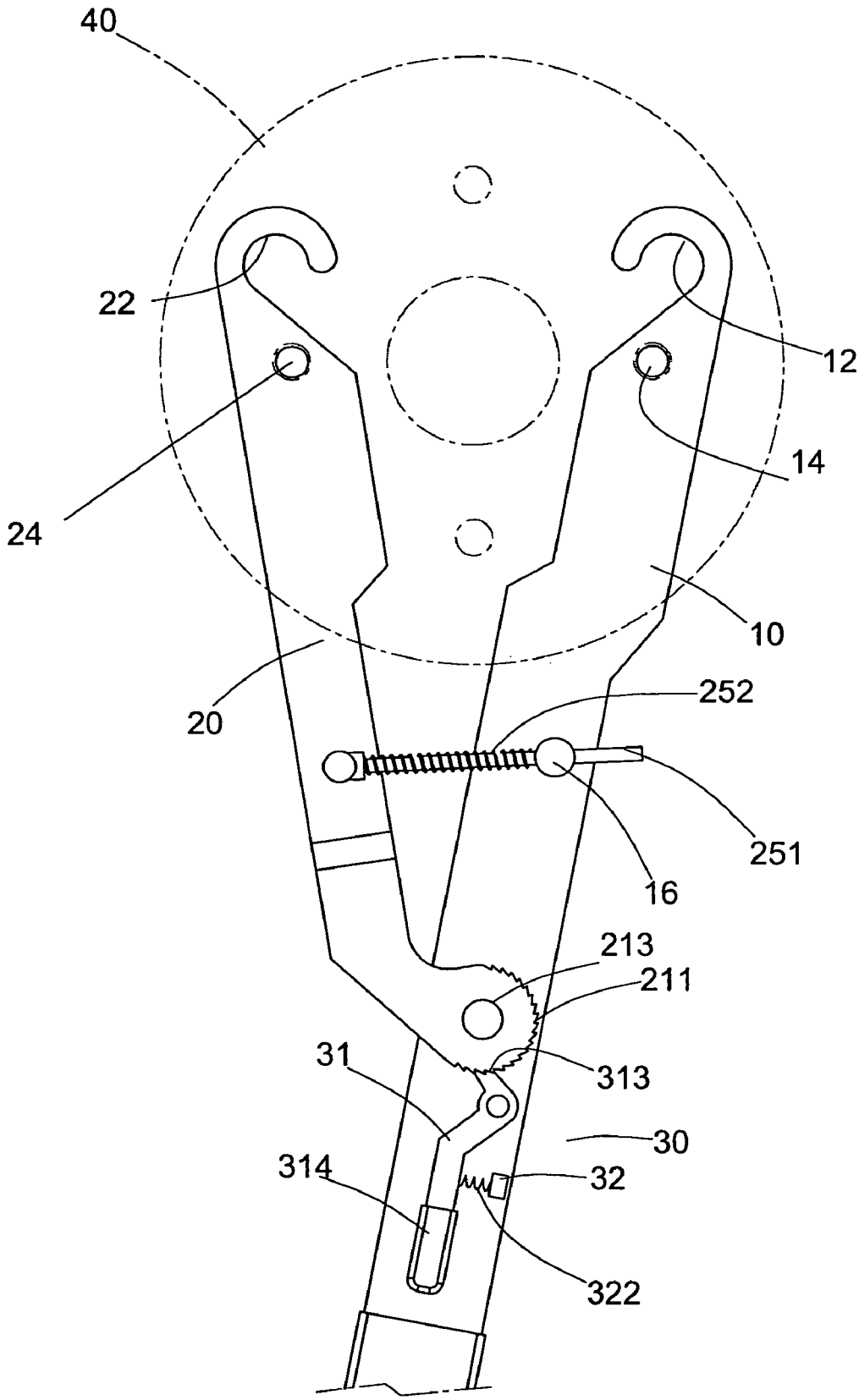
FIG. 7 is a second operational top plan view of the adjustable wrench of the present invention.

Please refer FIG. 7 that shows a second operational type of the wrench in accordance with the present invention. The actuated shaft (20) and the lever (31) is operated the way as described above. The first stub (14) of the main shaft (10) and the second stub (24) of the actuated shaft (20) are respectively inserted into two holes (not numbered) in the workpiece (40). Consequently, the user can conveniently detach/mount the workpiece (40) by using the wrench in accordance with the present invention.

Although the invention has been explained in relation to its preferred embodiment, it is to be understood that many other possible modifications and variations can be made without departing from the spirit and scope of the invention as hereinafter claimed.

What is claimed is:

1. An adjustable wrench for vehicle service, comprising:

a main shaft including:

a grip sleeved on a first end of the main shaft for user to operate the adjustable wrench;

a first hook formed on a second end of the main shaft and adapted to engage to a stub of a workpiece;

a first hole defined in the main shaft near the first hook and a first stub is axially detachably disposed in the first hole, the first stub adapted to be inserted into a hole in the workpiece; and a first through hole defined in a middle portion of the main shaft and a guider longitudinally partially secured in the main shaft between the first through hole and the first hole, the guider having a through hole laterally diametrically defined therein;

an actuated shaft with a circled first end pivotally mounted to the middle portion of the main shaft and including:

a series of ratchets formed on an outer periphery of the circled first end of the actuated shaft;

a second through hole centrally defined in the first end of the actuated shaft;

a pivot extending through the second through hole in the actuated shaft and the first through hole in the main shaft to pivotally mount the actuated shaft on the main shaft;

a second hook formed on a second end of the actuated shaft and corresponding to the first hook of the main shaft, the second hook adapted to engage to the stub extending from the workpiece;

a second hole defined in the actuated shaft near the second hook and corresponding to the first hole in the main shaft;

a second stub disposed in the second hole and adapted to be inserted into a hole in the workpiece;

a pillar longitudinally pivotally mounted to the actuated shaft and having a post laterally extending therefrom, the post extending through the through hole in the guider; and a spring compressively sleeved on the post between the pillar and the guider to provide a restitution force to the actuated force to the actuated shaft opening; and a controlling unit pivotally mounted on the main shaft for selectively braking the actuated shaft and including:

a lever pivotally mounted on the main shaft, and having an actuated portion formed on a first end thereof and a pawl formed on a second thereof, the pawl selectively engaged to the series of ratchets for braking the actuated shaft;

a stopper secured on the main shaft; and a tension spring having two opposite ends respectively connected to the stopper and the lever for providing a restitution force to the lever.

* * * * *